US006152387A

United States Patent [19]

Ricco

[11] Patent Number: 6,152,387

[45] **Date of Patent: *Nov. 28, 2000**

[54] ADJUSTABLE METERING VALVE FOR AN INTERNAL COMBUSTION ENGINE FUEL INJECTOR, AND RELATIVE METHOD OF ADJUSTMENT

[75] Inventor: Mario Ricco, Bari, Italy

[73] Assignee: Elasis Sistema Ricerca Fiat Nel Mezzogiorno Societa Consortile per Azioni, Pomigliano D'Arco, Italy

[ * ] Notice: This patent is subject to a terminal disclaimer.

[21] Appl. No.: 09/112,908

[22] Filed: Jul. 9, 1998

[30] Foreign Application Priority Data

Jul. 11, 1997 [IT] Italy ..... TO97A0618

[51] Int. Cl.[7] ..... B05B 1/30

[52] U.S. Cl. ..... 239/585.1; 239/588.3; 251/129.16; 251/129.18; 251/129.21

[58] Field of Search ..... 239/585.1, 585.2, 239/585.3, 585.4, 585.5, 533.1, 533.2, 533.3, 533.6, 533.8, 533.9, 533.15; 251/129.18, 129.16, 129.21; 123/470, 472; 335/273

[56] References Cited

FOREIGN PATENT DOCUMENTS

| | | |
|---|---|---|
| 0604915 | 7/1994 | European Pat. Off. . |
| 0753658 | 1/1997 | European Pat. Off. . |
| 0916843 | 5/1999 | European Pat. Off. . |

*Primary Examiner*—Andres Kashnikow
*Assistant Examiner*—Lisa Ann Douglas
*Attorney, Agent, or Firm*—Ladas & Parry

[57] ABSTRACT

The metering valve is fitted in a hollow body of the injector and is controlled by the armature of an electromagnet. The travel of the armature towards the electromagnet is arrested by a stop element fittable to the hollow body by a threaded element, which is screwed to a thread of the hollow body with a calibrated tightening torque to adjust the travel of the armature towards the electromagnet according to of the tightening torque. The method of adjustment includes the steps of fitting the stop element in the hollow body by a threaded element, and applying a calibrated tightening torque to the threaded element.

14 Claims, 2 Drawing Sheets

ADJUSTABLE METERING VALVE FOR AN INTERNAL COMBUSTION ENGINE FUEL INJECTOR, AND RELATIVE METHOD OF ADJUSTMENT

BACKGROUND OF THE INVENTION

The present invention relates to an adjustable metering valve for an internal combustion engine fuel injector, and to the relative method of adjustment.

A metering valve is normally controlled by the armature of an electromagnet, and is fitted to the body of the injector. The travel or lift of the armature towards the electromagnet core affects discharge of the injector, while the gap between the armature and the core affects response of the valve when the electromagnet is de-energized. As such, both the travel and gap must be set accurately.

Various metering valves are known in which the armature is connected to a stem guided by a sleeve with a stop flange; and the travel of the armature is defined by arrest of the flange against an edge of the sleeve. In one known metering valve, the sleeve is fitted inside the injector body with the interposition of a shim, and the electromagnet is fitted to the injector body by means of a jacket with the interposition of a second shim. In another known metering valve, the guide sleeve flange is fitted between a shoulder of the sleeve and an edge of the electromagnet jacket with the interposition of two groups of shims.

In both cases, the two shims are selected from a number of calibrated shims of modular thicknesses differing by a very small amount, which, for technical reasons, cannot be less than the machining tolerances, e.g. five micron. Adjusting the travel of the armature to a 5 micron tolerance, however, is often not accurate enough to keep discharge of the injector within the narrow range demanded by modern, particularly high-speed, internal combustion engines.

SUMMARY OF THE INVENTION

It is an object of the present invention to provide an adjustable metering valve and relative method of adjustment, enabling finer adjustment of the travel of the armature than that achievable using known shims, and which are both highly straightforward and reliable.

According to the present invention, there is provided a metering valve for an internal combustion engine fuel injector, wherein the metering valve is fitted to a hollow body of the injector, and is controlled by the armature of an electromagnet; the travel of said armature towards said electromagnet being arrested by a stop element fittable to said hollow body; characterized in that said stop element is so fitted by means of a threaded element, which is screwed to a thread of said hollow body with a calibrated tightening torque to adjust the travel of said armature towards said electromagnet by means of said tightening torque.

The method of adjusting the travel of said metering valve is characterized by the steps of: fitting said stop element inside said hollow body by means of a threaded element; and adjusting the travel of said armature towards said electromagnet by applying a calibrated tightening torque to said threaded element.

BRIEF DESCRIPTION OF THE DRAWINGS

Two preferred, non-limiting embodiments of the present invention will be described by way of example with reference to the accompanying drawings, in which.

DETAILED DESCRIPTION OF THE INVENTION

Figure 1:
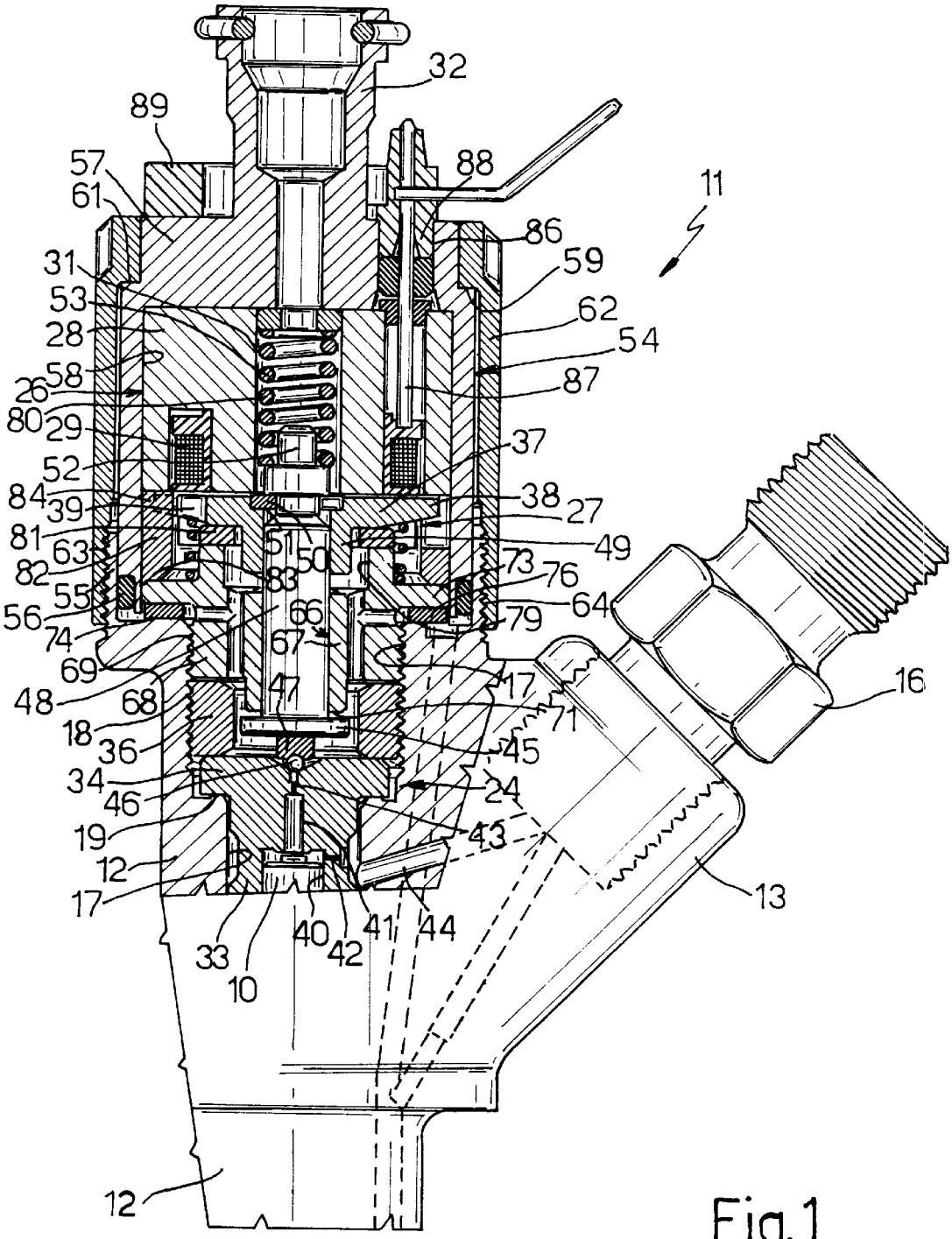
FIG. 1 shows a partial section of a fuel injector incorporating an adjustable metering valve according to a first embodiment of the invention.

Number 11 in FIG. 1 indicates as a whole a fuel injector, e.g. for an internal combustion engine. Injector 11 comprises a hollow body 12 fitted with a nozzle (not shown) terminating at the bottom with one or more injection orifices; a control rod 10 slides inside body 12, and is connected to a pin for closing the injection orifice; and body 12 comprises an appendix 13, in which is inserted an inlet fitting 16 connected to a normal fuel supply pump, and a substantially cylindrical cavity 17 having a thread 18 and a shoulder 19.

Injector 11 also comprises an adjustable metering valve indicated as a whole by 24, and which is housed inside cavity 17 and controlled by an electromagnet 26 controlling an armature 27. Electromagnet 26 has an annular magnetic core 28 housing a normal electric coil 29; and core 28 has a central hole 31 coaxial with a discharge fitting 32 connected to the fuel tank.

Metering valve 24 comprises a cylindrical valve body 33 having a flange 34, which is normally held resting against shoulder 19 of cavity 17 by a ring nut 36 threaded externally and screwed to thread 18 of cavity 17. Armature 27 substantially comprises a disk 37 having three sectors 38 separated by openings 39; body 33 of valve 24 comprises a control chamber 41 having a discharge conduit 43 communicating with cavity 17; hollow body 12 comprises an axial hole 40 adjacent to chamber 41 and in which rod 10 slides; and body 33 comprises an inlet conduit 42, which terminates in hole 40 and communicates with fitting 16 via a conduit 44 of hollow body 12.

The fuel pressure keeps rod 10 normally in the lowered position closing the orifice of the nozzle of injector 11; discharge conduit 43 of control chamber 41 is normally closed by a ball 46, which rests on a conical seat defined by the contact surface with conduit 43; and ball 46 is guided by a guide plate 47 on which acts a flange 45 of a cylindrical stem 48 connected to armature 27.

More specifically, disk 37 of armature 27 is integral with a sleeve 49 sliding axially on stem 48; stem 48 has a groove in which is inserted a C-shaped ring 50 cooperating with a shoulder 51 of armature 27, so that armature 27 is disconnected from stem 48; and stem 48 extends a given length inside hole 31, and terminates with a small-diameter portion 52 for supporting and securing a compression spring 53 housed inside hole 31.

Core 28 of electromagnet 26 is housed inside a jacket indicated as a whole by 54, and which is made of nonmagnetic material and connected to a portion 55 of hollow body 12 by a seal 56. Jacket 54 is integral with an end wall 57 supporting fitting 32, has a perfectly cylindrical inner surface 58, and has an outer shoulder 59 engaged by an inner shoulder 61 of a cylindrical cover 62 having an inner thread 63 which screws onto an outer thread 64 of portion 55 of body 12.

Metering valve 24 comprises a guide member indicated as a whole by 66 and comprising a sleeve 67 in which slides stem 48 of armature 27. The metering valve has a stop element for arresting armature 27, said stop element being defined by the bottom edge 71 of sleeve 67, against which is arrested a shoulder defined by flange 45 of stem 48. Sleeve 67 also has a threaded element defined by a portion 68 having a larger outside diameter and an external thread 69, which screws onto thread 18 in cavity 17.

Guide member 66 has a flange 73, which rests against a further shoulder 74 of hollow body 12 via a calibrated spacer or shim 76 selectable from a class of modular shims. As is known, for technical reasons, the the class of spacers 76 may vary in thickness by no less than five micron, and therefore provides for preadjusting the travel of armature 27 to five-micron precision.

When subjected to the tightening torque, i.e. the screwing torque, of portion 68, however, flange 73 undergoes a certain amount of flexure, which, within certain limits, is substantially proportional to the torque. The thickness of flange 73 and the outside diameter of portion 68 may be so sized as to obtain a predetermined displacement, e.g. of one micron, of edge 71 for a predetermined variation in the tightening torque, so that, by varying the tightening torque, the travel of armature 27 may be adjusted to one-micron precision. Advantageously, said thickness and diameter may be so sized as to obtain a one-micron displacement for a one newton/m variation in the tightening torque.

Guide member 66 has a prismatic seat 79 for a known Allen torque wrench; and a compression spring 80, over which prevails spring 53, is fitted between flange 73 and disk 37 of armature 27.

Another spacer 82 is provided between core 28 of electromagnet 26 and flange 73, and comprises an annular portion 83 which rests against flange 73, and a number of feet 84 integral with annular portion 83. Feet 84 fit through the openings 39 in disk 37 of armature 27 to engage core 28 of electromagnet 26, so that spacer 82 is in the form of a tripod. Spacers 82 with feet 84 of modular lengths differing by very small amounts are provided, so that spacer 82 is selectable from a class of modular spacers to adjust the gap between disk 37 of armature 27 and core 28.

End wall 57 of jacket 54 has a hole 86 through which extends an electric cable 87 for connecting coil 29 electrically to the usual electric circuit of the engine. Cable 87 is embedded in an appendix 88 of a ring 89 of insulating plastic material.

Metering valve 24 of injector 11 is assembled as follows.

Body 33 of valve 24 is inserted inside cavity 17 of hollow body 12, and ring nut 36 is screwed to thread 18 until flange 34 contacts shoulder 19. Spacer 76 is then selected from the class of available spacers to obtain a travel of armature 27 as close as possible to that required to obtain the desired discharge of injector 11, and so effect a preadjustment of the travel of armature 27.

Stem 48 of armature 27 is then inserted inside sleeve 67 of guide member 66, and the selected spacer 76 is placed on shoulder 74 of body 12. Using an Allen torque wrench inside prismatic seat 79, thread 69 of portion 68 is then screwed to thread 18 of body 12 until flange 73 contacts spacer 76, at which point, flange 73 is forced with a predetermined tightening torque, e.g. of 30 newtons/m.

Injector 11, together with metering valve 24, is then placed on a known test bench; the discharge in $mm^3$ is measured at various pressures and within a predetermined time interval; and the test discharge curve is compared with a reference discharge curve to determine whether the test discharge curve falls within a given range comprising the reference discharge curve. If the test discharge curve is outside the given range, another spacer 76 is selected.

Conversely, if the test discharge curve is within the given range, the travel of armature 27 may be adjusted accurately by determining, from appropriate tables, the variation in travel required to bring the test discharge curve as close as possible to the reference discharge curve. On the basis of said variation in travel, the tightening torque in newtons/m required to finely adjust the travel is determined.

At this point, spacer 82 is placed over guide member 66, with annular portion 83 against flange 73; spring 80 is placed on flange 73, and bush 81 on member 66; sleeve 49 of armature 27 is inserted between stem 48 and bush 81, and, by compressing spring 80, C-shaped ring 50 is inserted inside the groove on stem 48; and electromagnet 26 is inserted inside jacket 54, and spring 53 inside hole 31 of core 28.

At this point, seal 56 is inserted inside the seat on jacket 54; jacket 54 is inserted inside portion 55 of hollow body 12 so that core 28 contacts feet 84 of spacer 82 and end wall 57 of jacket 54; cover 62 is fitted to jacket 54, and thread 63 is screwed to thread 64 of hollow body 12 until shoulder 61 engages shoulder 59 of jacket 54, so that wall 57 presses core 28 against spacer 82, which in turn presses against flange 73; and ring 89 is fitted to fitting 32 so as to rest on the outer surface of wall 57.

Figure 2:
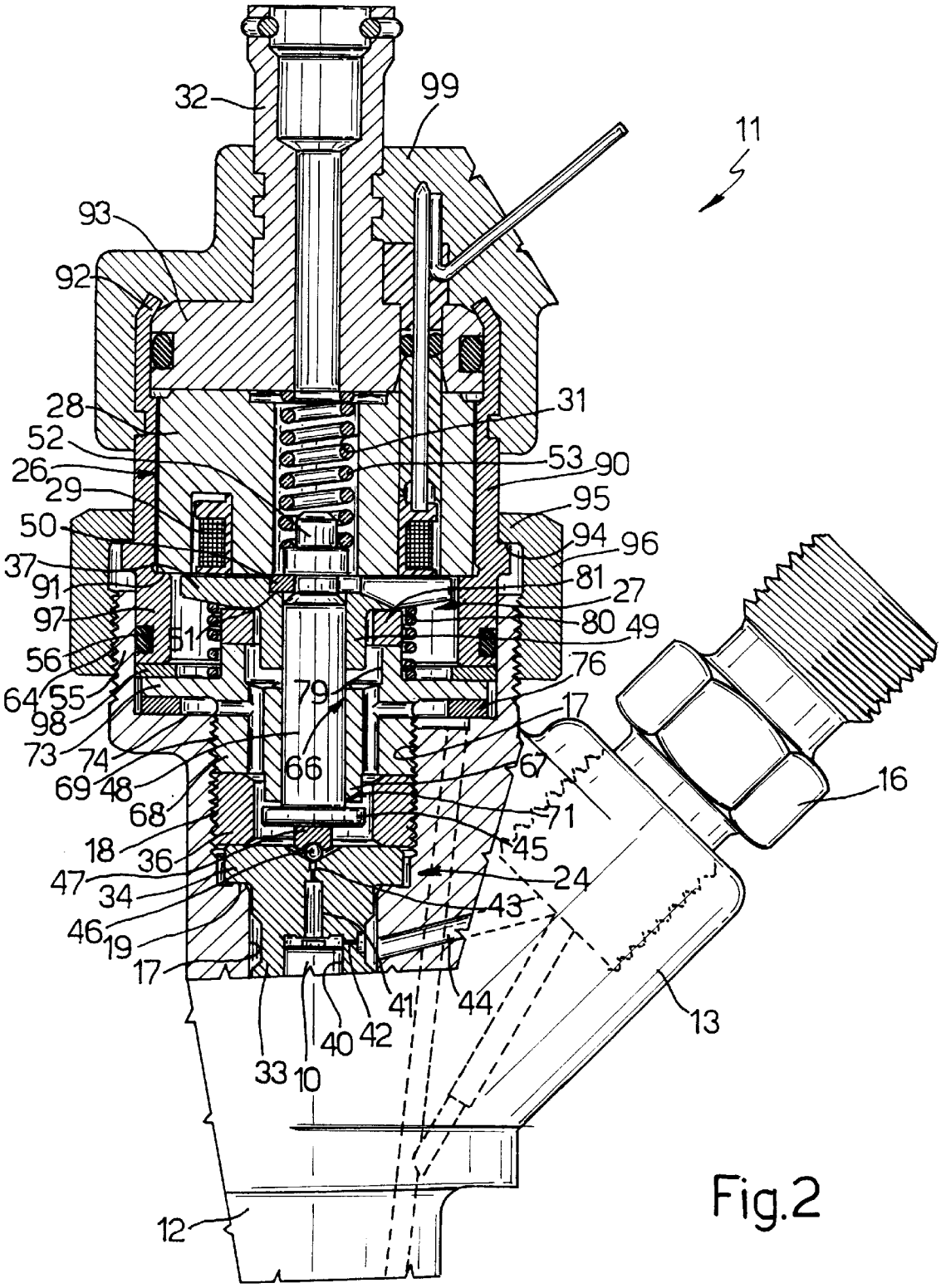
FIG. 2 shows a partial section of an injector incorporating an adjustable metering valve according to a further embodiment of the invention.

In the FIG. 2 embodiment, in which the parts corresponding to those in FIG. 1 are indicated using the same numbering system with no further description, after inserting stem 48 inside guide member 66, connecting disk 37 of armature 27 to stem 48, and placing calibrated spacer 76 on shoulder 74, thread 69 of portion 68 is screwed to thread 18 of hollow body 12 with a 30 newton/m tightening torque; the travel of armature 27 is adjusted accurately in exactly the same way as in FIG. 1; and, finally, the edge 92 region is covered with a cap 99 of insulating plastic material.

Electromagnet 26, on the other hand, is fitted separately to a jacket 90 of electromagnetic 26, which jacket in this case has an inner shoulder 91, and is fitted to fitting 32 by deforming an edge 92 on a disk 93 integral with fitting 32, so as to lock core 28 between shoulder 91 and disk 93.

Jacket 90 also has an outer shoulder 94, which is engaged by an inner projection 95 of a threaded ring nut 96, which screws onto thread 64 of hollow body 12; and, between a bottom edge 97 of jacket 90 and flange 73 of guide member 66, a shim or spacer 98 is provided to determine the gap between disk 37 and core 28 in the same way as spacer 82 in FIG. 1.

The method of adjustment according to the present invention therefore substantially comprises the step of fitting stop element 71 to hollow body 12 by means of a threaded element 68, and the step of adjusting the travel of armature 27 towards electromagnet 26 by applying a calibrated tightening torque to threaded element 68.

As compared with known metering valves, the advantages of the adjustable metering valve according to the present invention will be clear from the foregoing description. In particular, it provides for a much more accurate fine adjustment than that achievable using known techniques; adjustment is made by simply adjusting the tightening torque; and, finally, adjustment may even be made when repairing or servicing the injector.

Clearly, changes may be made to the injector as described and illustrated herein without, however, departing from the scope of the accompanying Claims. For example, the method may be implemented by an automatic device comprising a discharge measuring station, and a station for correcting the tightening torque accordingly. Moreover, the gap between disk 37 of armature 27 and core 28 may also be adjusted finely by adjusting the tightening torque of portion 68 (FIG. 1) or ring nut 96 (FIG. 2) on body 12.

What is claimed is:

1. An adjustable metering valve for an internal combustion engine fuel injector, wherein the metering valve (24) is fitted to a hollow body (12) of the injector (11), and is controlled by an armature (27) of an electromagnet (26); travel of said armature (27) towards said electromagnet (26) being arrested by a stop element (71) fittable to said hollow body (12); wherein said stop element (71) is so fitted by means of a threaded element (68), which is screwed to a thread (18) of said hollow body (12) with a calibrated tightening torque to adjust the travel of said armature (27) towards said electromagnet (26) by means of said tightening torque.

2. A metering valve as claimed in claim 1, wherein said stop element (71) is carried by a guide member (66) of said armature (27); said threaded element (68) being integral with said guide member (66).

3. A metering valve as claimed in claim 2, wherein a valve body (33) of the metering valve is fitted to said hollow body (12) by means of a ring nut (36); wherein said guide member (66) comprises a flange (73) larger in diameter than said threaded element (68); said flange (73) being arrested against a shoulder (74) of said hollow body (12); and said tightening torque elastically deforming said flange (73).

4. A metering valve as claimed in claim 3, wherein said electromagnet (26) comprises an annular core (28), and said armature (27) comprises a disk (37) cooperating magnetically with said core (28); wherein said disk (37) is connected to a stem (48) sliding inside a sleeve (67) of said guide member (66); said stop element being defined by an edge of said sleeve (67), and arresting a step (45) of said stem (48).

5. A metering valve as claimed in claim 3, wherein said flange (73) is forced against said shoulder (74) with the interposition of a spacer (76) of a thickness selectable from a number of modular thicknesses to preadjust said travel.

6. A metering valve as claimed in claim 5, wherein said core (28) is connected to said guide member (66) by a further threaded element (63, 96) associated with an outer jacket (62, 90) of said electromagnet (26).

7. A metering valve as claimed in claim 4, wherein said core is connected to said guide member by a further threaded element associated with an outer jacket of said electromagnet, and wherein said further threaded element (63) is integral with said outer jacket (62), and is screwed to an external thread (64) of said hollow body (12); a further spacer (82) being provided between said core (28) and said flange (73), and being selectable from a class of spacers to adjust a gap between said disk (37) and said core (28).

8. A metering valve as claimed in claim 4, wherein said core is connected to said guide member by a further threaded element associated with an outer jacket of said electromagnet, and wherein said further threaded element is integral with a further ring nut (96) screwed to an external thread (64) of said hollow body (12); said outer jacket (90) having a shoulder (94) which is engaged by a projection (95) of said further ring nut (96); wherein, between said outer jacket (90) and said flange (73), there is provided a spacer (97) selectable from a class of spacers to adjust a gap between said disk (37) and said core (28).

9. A method of adjusting a metering valve of an internal combustion engine fuel injector, wherein the metering valve (24) is fitted in a hollow body (12) of the injector (11) and is controlled by an armature (27) of an electromagnet (26); and wherein travel of said armature (27) towards said electromagnet (26) is arrested by a stop element (71) fittable to said hollow body (12); the method comprising the steps of: fitting said stop element (71) inside said hollow body (12) by means of a threaded element (68); and adjusting the travel of said armature (27) towards said electromagnet (26) by applying a calibrated tightening torque to said threaded element (68).

10. A method as claimed in claim 9, wherein said stop element is defined by a portion (71) of a guide member (66) of said armature (27).

11. A method as claimed in claim 10, comprising the steps of: fitting said guide member (66) by applying a predetermined tightening torque to said threaded element (68); measuring the discharge of the injector (11); comparing the result of said measurement with a reference discharge; and adjusting said travel by adjusting said tightening torque as a function of said comparison.

12. A method as claimed in claim 11, wherein said guide member (66) is fitted to said hollow body (12) with the interposition of a calibrated spacer (76); wherein said adjustment is a fine adjustment; a preadjustment of said travel being made by selecting the thickness of said spacer (76) from a class of spacers of modular calibrated thicknesses.

13. A method as claimed in claim 12, wherein said threaded element (68) is integral with said guide member (66); said fine adjustment being made by means of a torque wrench.

14. A method as claimed in claim 11, wherein said measurement is made at various fuel pressures; said comparison being made between a curve of a graph of said measurements and a range about a curve of a reference discharge graph.

* * * * *